United States Patent [19]

Shah

[11] Patent Number: 4,511,361

[45] Date of Patent: Apr. 16, 1985

[54] METHOD OF MARKING PAPERMAKERS' FELT BY TRANSFER PRINTING

[75] Inventor: Shirish M. Shah, Piqua, Ohio

[73] Assignee: The Orr Felt Company, Piqua, Ohio

[21] Appl. No.: 604,357

[22] Filed: Apr. 27, 1984

[51] Int. Cl.[3] ..... D06P 3/82; D03D 23/00

[52] U.S. Cl. ..... 8/471; 8/531; 8/533; 8/919; 8/922; 8/924; 8/925; 34/95; 162/358; 139/383 A

[58] Field of Search ..... 8/471, 533, 531

[56] References Cited

U.S. PATENT DOCUMENTS

| | | | |
|---|---|---|---|
| 3,613,258 | 10/1971 | Jamieson | 34/95 |
| 3,657,068 | 4/1972 | Ivanowicz | 162/258 |
| 4,187,618 | 2/1980 | Diehl | 34/243 R |
| 4,226,594 | 10/1980 | Renaut | 8/471 |
| 4,281,598 | 8/1981 | Rump | 8/471 |
| 4,421,518 | 12/1983 | Gorondy | 8/471 |

FOREIGN PATENT DOCUMENTS 1030994 5/1966 United Kingdom .

*Primary Examiner*—A. Lionel Clingman
*Attorney, Agent, or Firm*—Biebel, French & Nauman

[57] ABSTRACT

A method of applying alignment stripes to the surface of a papermakers' felt includes the steps of printing a dye pattern in the form of the stripes on a sheet of transfer paper, employing heat sublimatible transfer dyes, applying such a sheet with the transferable dye thereon adjacent an inside surface of a felt as mounted on a felt finishing setup which includes a heated head roll, and causing said sheet to be drawn with the felt between the felt and heated roll, while maintaining tension in the felt. The heated head roll causes the transfer of the dye pattern defining the alignment strip from the sheet to the adjacent surface of the felt.

5 Claims, 3 Drawing Figures

METHOD OF MARKING PAPERMAKERS' FELT BY TRANSFER PRINTING

BACKGROUND OF THE INVENTION

This invention pertains to papermakers' felts and more particularly to a method of applying marks or stripes on such felts, such as alignment stripes to aid the papermaker in aligning the felt with respect to the machine, and thereby prevent the felt from being run on a bias. Papermakers' felts commonly have alignment stripes on the face side of the felt. Occasionally alignment stripes may be found on the back side or on both sides. These colored stripes contrast to the background color of the felt, and may be viewed when standing alongside a papermakers' machine to judge the trueness of the felt on the machine, permitting the operator to make whatever alignment adjustments are necessary so that the felt runs true to the machine.

The conventional method of forming alignment stripes on the papermakers' felts consist of loading a finished felt onto a steam table, also known as a "stripe table". The stripe or stripes are applied using a silk screen box and a paste dye. The paste dye is commonly a water mixture of a filler jell, a dye, and a small amount of acid, acetic acid for nylon and nylon wool blends, and formic acid for dacron. Depending on the type of felt, the dyed stripe area of the felt is then selectively steam heated from 20 to 40 minutes, by the application of steam thereto, to set the dye. Only the portion or portions of the felt carrying the stripes are steamed, which may typically encompass about three linear feet of the felt, from one side thereof to the other. As a result, the felt in that area tends somewhat to shrink, and when the felt is loaded on the dryer, the areas on both sides of the non-steamed area or the stripes tend to show up as slack areas, while the stripe area itself appears to be tight. This differential shrinkage can seldom be completely eliminated during the heat set process and therefore, on the most demanding of paper machine applications, it can cause a ripple in the paper.

A typical felt may be 120" wide, and weigh 150 pounds. However, extremely wide felts are coming into use on new papermaking machines which may exceed 300" in width, may extend a length from 120' to over 200' and may weigh up to 1,300 pounds or more. The manpower required in handling such a felt, applying the same to a stripe or steam table for the silk-screen application of alignment stripes thereto, the steaming of the stripe area to set the dye and the removal of such a felt from the steam table constitutes a substantial investment in both time and manpower. A typical striping operation, using silk screen boxes and water paste dye may take from one to two hours to complete, on an average size felt, and this time can be longer for a wide felt. In addition, the specifications for some felts require that alignment stripes be applied to both sides of the felts, requiring additional expenditures of time and manpower.

A further disadvantage of the silk-screen striping process resides in the fact that the silk-screen material must be freshly mixed on a daily or every second day basis. The material, if stored overnight, requires special handling. Further, the screens themselves must be carefully and thoroughly washed in specially designed pits to accommodate the same at the end of each day, to prevent the screens from filling. In addition, even with careful handling screens become torn or simply worn out and require maintenance and repair.

A further disadvantage of the conventional silk screened dye stripe is the change in the porosity or air permeability of the felt in the region of the stripe due to shrinkage occurring in the steaming process and dyeing. It is inherent that the substance of the dye somewhat fills the felt, and decreases the openness and porosity of the felt at the dyed regions. This again is a disadvantage where maximum openness and uniformity are required.

SUMMARY OF THE INVENTION

This invention is directed to a method of applying alignment stripes to papermakers' felts which substantially eliminate the problems which have been associated with the steamed-in dye process as previously used. The method includes the employment of a dye transfer medium in which dyes, carried on a transfer paper, are applied by the use of heat and pressure to the surface of the felt.

In the manufacture of a papermakers' felt, which may consist of synthetic or synthetic-wool blends of batting material which has been needled onto a woven base, it is necessary to wash the felt, spin the felt to remove excess water, and then finish the damp felt in a finishing room. The finishing room typically has a heated head roll, which is oil-heated to a given temperature, an adjustably mounted tail roll for taking up the slack of the felt and for providing a given and uniform tension to the felt during finishing, a compactor roll which runs selectively into engagement with the felt against the head roll, and one or more auxiliary heater arrangements by means of which heat may be applied to the exterior surface of the felt in the region of the head roll. The damp felt is loaded onto the head roll and tail roll in such a finishing room, the tail roll is moved away from the head roll to provide the desired tension in the felt, and the finishing operation begins. The practice of the process of the invention advantageously takes place while the felt is still mounted on the rolls in the finishing room, at the completion of the conventional finishing operation thereto.

In the practice of the process of this invention, a strip of dye transfer paper, on which a transferrable dye pigment has been printed, silk screened, or otherwise suitably placed, is temporarily fastened transversely across the width of the felt, with the transfer dye facing the felt, while it is on the finishing setup. The strip is then caused to be drawn, by rotation of the head roll, between the heated roll and the felt, while maintaining the temperature and pressure thereon, and while maintaining tension in the felt, for a time sufficient to cause the dye to sublime and be carried from the paper carrier to the fibers of the adjacent felt and permanently fixed thereto.

In the practice of the process, a roll of paper is provided on which the alignment stripes have been printed on one side thereof. The paper industry has developed papers which meet the requirements for transfer printing with aqueous color pastes which have also been designed for dye transfer. The paper, as known in the paper industry, should have good uniformity and dimensional stability. It must also have high absorbency and low dye retention behavior during transferring. These requirements may be met by employing a machine-glazed bulky paper with adequate wet tear strength. The dye, which may be silk screened or off-set printed in the desired pattern of the alignment stripes is generally liquid, concentrated disperse dyes which contain reduced amounts of electrolytes, and which have been developed by the dye industry for paper printing of patterns on textiles.

In the practice of the method of this invention, it is preferred to apply the alignment stripes as a last step before unloading the felt while the felt is still mounted on the finishing and drying setup. The stripes are applied to the inside surface of the felt, that is the surface of the felt against the heated head roll or drum, by temporarily securing the transfer paper, with the dye pattern thereon, in transverse alignment to the felt, and then pass the transfer paper through the drum nip on a single pass, at a rate of rotation which, together with the heat of the drum, provides for substantially complete transfer of the dye on the paper to the adjacent surface of the felt. Thereafter, the felt which is now finished and dry, may be removed from the drying setup and turned inside out in the conventional manner, bringing the alignment stripes to the desired outer surface of the felt. It is important that after the transfer paper is removed, the felt should be turned over on the finishing setup or completely removed therefrom, without allowing the newly finished stripe to come into direct contact with the heated drum. The striping step is commonly the last step in the process, and the stripe may now be considered to be permanently on the felt as it is unlikely that the felt stripe will thereafter come into direct contact with a high temperature heated roll, under tension, on a paper machine such that it would cause the dye to transpose.

The marking comprising the alignment stripe is now permanently formed in the surface fibers of the felt, but the porosity thereof remains substantially open and unaffected by fillers or the like which were common with the paste dyes of the former steam method. Further, since the dyes have been set by essentially dry heat of the drum, it is not necessary to steam any section of the finished felt merely for the purpose of setting the dyes. Therefore, the tendency for tight and slack areas by reason of such subsequent steaming and drying is eliminated.

It is accordingly an important object of the invention to provide a method for applying alignment stripes to a papermakers' felt.

An additional object of the invention is the provision of a method of manufacturing a felt, with alignment stripes thereon, which are applied by the dye transfer method.

A further object of the invention is the provision of the method of applying alignment stripes to a papermakers' felt, as outlined above, in which the conventional finishing setup is used, in a dye transfer process, for applying the alignment stripes following the conventional drying of a washed felt thereon.

These and other objects and advantages of the invention will be apparent from the following description, the accompanying drawings and the appended claims.

DESCRIPTION OF PREFERRED EMBODIMENT

Figure 1:
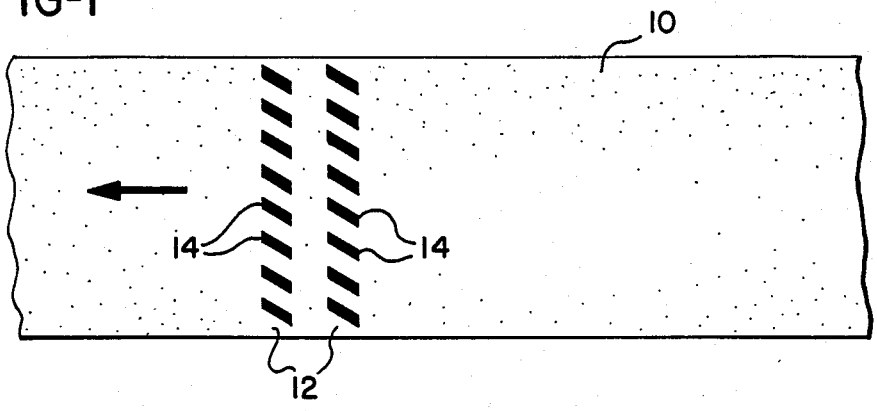
FIG. 1 is a fragmentary view of a papermakers' felt showing alignment stripes thereon.

A fragment of a papermakers' felt is illustrated generally at 10 in FIG. 1. The felt may be a needled felt, composed of synthetic fibers such as nylon, aramide fibers, or polyester or a blend of synthetic and wool fibers, and may be of the type disclosed in U.S. Pat. Nos. 3,657,068 or 4,187,618, for example. The felts of this kind thus generally include a base structure formed of woven material, onto which has been applied, by needling, one or more non-woven battings of material on either or both of the surfaces thereof.

In the cross machine direction, that is transverse to the length of the felt, it is common to provide one or more transversely oriented alignment stripes, designated generally by the reference numeral 12 in FIG. 1. Two alignment stripes are illustrated as applied to the outer surface of the felt 10 in FIG. 1, each stripe consisting of a series of small transversely spaced parallelograms 14. When viewed from the edge, the leading and trailing edges of the parallelograms 14 may be readily viewed as being in alignment and providing an indication of the relative alignment of the felt on the papermaking machine. The geometric pattern provided by the parallelograms forming the composite alignment stripes 12 is only a preferred arrangement, and solid stripes or other forms of marking may be employed for this purpose.

Figure 2:
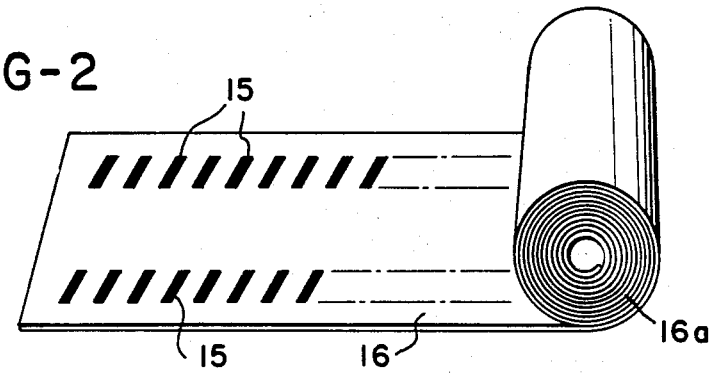
FIG. 2 is a fragmentary view of dye transfer paper having transfer dye applied thereto, in the form of alignment stripes.

As shown in FIG. 2, the segments 15 of dye making up the individual parallelograms 14 of the alignment stripes 12 are applied to a sheet 16 of transfer paper. As previously noted, any commercial grade of dye transfer paper may be used, characterized by good bulk, and good wet strength, as known in the art. A transfer dye, in the proper color, is applied to the surface of the paper, such as by roll printing or silk screening. The width of the paper sheet 16 is only sufficient to carry the alignment segments 15 thereon, as the same will be positioned transversely of the web during application.

The transfer dye formulation should be selected so as to be compatible with the kind of fibers to which the dye is being applied. It has been found that transfer dyes which are sold in the United States by BASF Wyandotte Corporation of Charlotte, N.C. 28266 under the trademark "Bafixan" (which may consist of approximately 18–20% transfer dye combined with a commercially available thickening agent), may be employed as the transfer dye 15 applied to the sheet 16. The "Bafixan" brand of dyes are particularly formulated for application to textiles, at a sublimination temperature of from about 190° to 220° C., over a period of about 20 to 30 seconds. However, it has been found that suitable transfers can be made from the sheet 16 to the felt 10, at substantially lower temperatures in the order 175° C., by lengthening the period of time that the transfer paper is in pressure and temperature contact with the felt.

As previously noted, in the normal process of finishing a felt, the completed felt is washed and then finished on a finishing apparatus which includes a heated head roll 20, a tail roll 22, and a compactor roll 24 in pressure contact with a felt on the heated roll 20. The heated roll 20, which may be heated by hot oil, is normally operated in the region of 175° C. during the finishing and drying operation, and while the felt is maintained under tension between the head roll and the tail roll. For example, the tension applied may be in the order of 165 pounds per linear inch of width, the exact tension applied being determined by the kind of felt being finished, the construction of the woven base, and its width. It is preferred to operate the head roll from a source of heated oil at a temperature of around 175° C., although higher temperatures may be used.

Preferably, the felt is finished inside out, in that what will become its outer running surface on the paper machine is applied against the rolls 20 and 22 as the inner surface. Also, commonly, it is this surface to which the alignment stripes are usually applied.

Figure 3:
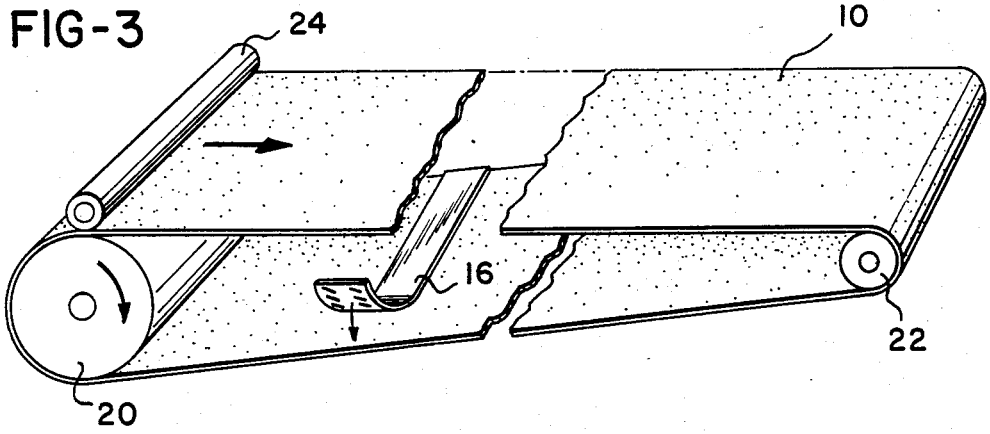
FIG. 3 is a diagrammatic view of a papermakers' felt on a dryer setup, and showing the manner of attachment of the transfer paper thereto prior to transferring the alignment stripe from the paper to the felt.

In the practice of the process of this invention, a felt 10, as shown in FIG. 3, is completely finished in the normal operation, on the finishing setup of FIG. 3. A length of the paper strip 16 is severed from a roll 16*a* in a length corresponding to the width of the felt and is applied, with the printed side down, against the inside surface of the felt 10, as illustrated in FIG. 3. The strip 16 may be suitably temporarily secured in place, such as by stapling to the felt 10 so that the dye pattern 15 faces the adjacent inside surface of the felt.

With the drum temperature maintained at about 175° C., the felt is moved at a relatively slow speed, making one full pass over the heated head roll 20, with the compactor roll 24 in place and while tension is applied to the felt. It is not necessary to use a compactor roll to carry out this process. The rate of rotation or rate of movement of the felt is related to the diameter of the roll 20 so as to assure contact over a duration of about 2 to 4 minutes. For example, with a five foot diameter drum or roll, in order to assure a preferred 3 minute contact time of the paper with the felt on the drum, the felt is moved at the rate of approximately 4 feet per minute, and the motion is stopped for approximately 1 minute of dwell time, thereby providing approximately 3 minutes of contact time. It has been found that such contact time has no harmful effect on either the dye or the felt, and full sublimination at this substantially lower temperature is effected, resulting in the pattern on the strip 16 being transferred to the adjacent surface of the felt in such a single pass. Thereafter, the spent paper sheet is removed and the felt is removed from the dryer setup. As noted above, the dwell time of the strip 16, to effect sublimation and transfer of the dye thereon, may be reduced in instances where the head roll is operated at temperatures in excess of 175° C. Thus, if the head roll were operated at a temperature of around 190° C., the dwell time may be reduced to a range of about 1 to 1 ½ minutes. However, in most cases, it would not be desirable to heat the head roll up to this temperature merely for the purpose of dye transfer alone, since it has been found that good transfer can take place at temperatures below that recommended by the dye industry, merely by increasing the dwell time above that recommended by the industry, from the 15–30 seconds recommended up to the approximately 3 minutes of the preferred process steps of this application.

In instances where it is desired to place an alignment stripe on both the outside and the inside running surfaces of the felt, the tail roll can be brought in, and the compactor roll lifted. The felt may then be inverted while remaining on the finishing setup, to put what was the inside surface to the outside. The tail roll is then returned to its initial position of tension, the compactor roll 24 is brought down again into engagement with the felt, and the steps outlined above are repeated to place the alignment stripes at the desired location.

While the method herein described, constitutes preferred embodiment of this invention, it is to be understood that the invention is not limited to this precise method and, and that changes may be made in either without departing from the scope of the invention, which is defined in the appended claims.

What is claimed is:

1. The method of marking a papermaker's felt in which the felt is composed of synthetic fibers or a blend of synthetic and wool fibers, with alignment stripes extending transversely of the felt, comprising the steps of:

supporting the felt on a pair of rolls in tension, applying a sheet having dye transfer color pigment printed thereon transversely of the felt on an inside surface thereof between said rolls, applying heat to one of said rolls and rotating said rolls to cause said sheet to be brought between the felt and the heated roll, causing said sheet to dwell on said heated roll for a length of time sufficient to transfer the dye pigment therefrom to said inside felt surface, and removing said paper.

2. The method of applying alignment stripes to the surface of a papermaker's felt in which the felt is composed of synthetic fibers or a blend of synthetic and wool fibers, comprising the steps of:

supporting the felt between a pair of rolls, one of which is heated, providing a paper dye transfer sheet on which said alignment stripes are printed in the form of heat transferable dye pigments, and positioning said sheet with said stripes thereon transversely across the width of said felt on an inside surface thereof with respect to said rolls and driving at least one of said rolls to cause said felt and paper to be carried over said heated roll with a dwell time sufficient thereon to cause the transfer of said dye from said sheet to said felt.

3. The method of claim 2 in which the temperature of said heated roll is in the order of 175° C. and said dwell time is in the order of two to four minutes.

4. Method of applying alignment stripes to the surface of a needled papermaker's felt, in which the felt is composed of synthetic fibers or a blend of synthetic and wool fibers, in which felt is finished on a finishing setup including an oil heated roll, and a tail roll for applying tension to the felt against the head roll, comprising the steps of:

finishing a felt on such finishing setup in a conventional manner until such felt is substantially dry, providing a paper dye transfer sheet on which alignment stripes are printed in the form of heat transferable dye pigments, positioning a section of said sheet with alignment stripes thereon transversely across the width of said felt on an inside surface thereof with respect to said rolls, and rotating said rolls to cause the felt to carry said paper sheet between the felt and the heated head roll, while maintaining finishing temperature in the heated head roll and while maintaining finishing tension on the felt, to cause the stripe to be carried in the nip between the felt and the head roll with a dwell time sufficient to cause sublimation and transfer of the dye from said sheet to the adjacent surface of the felt, and thereafter removing said sheet from said felt.

5. The method of claim 4 in which the head roll is maintained at a temperature in the order of 175° C. and the dwell time is in the order of between two to four minutes.

* * * * *